US005327980A

United States Patent [19]

Smet

[11] Patent Number: 5,327,980

[45] Date of Patent: Jul. 12, 1994

[54] DRILL HEAD

[76] Inventor: Marc J. M. Smet, Kasteelstraat 29, 2400 Mol, Belgium

[21] Appl. No.: 775,606

[22] Filed: Oct. 15, 1991

[30] Foreign Application Priority Data

Oct. 15, 1990 [BE] Belgium ..... 09000972

[51] Int. Cl.[5] ..... E21B 7/18

[52] U.S. Cl. ..... 175/21; 175/26

[58] Field of Search ..... 175/67, 26, 107, 340, 175/61, 65, 325.4, 345

[56] References Cited

U.S. PATENT DOCUMENTS

| | | | |
|---|---|---|---|
| 3,133,603 | 5/1964 | Lagacherie et al. | 175/107 |
| 3,749,185 | 7/1973 | Tiraspolsky et al. | 175/26 |
| 3,840,080 | 10/1974 | Berryman | 175/107 |
| 4,031,971 | 6/1977 | Miller | 175/107 |
| 4,133,397 | 1/1979 | Tschirky | 175/96 |
| 4,185,706 | 1/1980 | Baker, III et al. | 175/340 |
| 4,534,427 | 8/1985 | Wang et al. | 175/67 |
| 4,744,420 | 5/1988 | Patterson et al. | 175/67 X |
| 4,850,440 | 7/1989 | Smet | 175/67 |
| 4,871,037 | 10/1989 | Warren et al. | 175/67 |
| 4,921,057 | 5/1990 | Smet | 175/67 X |
| 4,991,667 | 2/1991 | Wilkes, Jr. et al. | 175/67 X |

FOREIGN PATENT DOCUMENTS

| | | |
|---|---|---|
| 60261 | 3/1975 | Australia . |
| 0335543 | 10/1989 | European Pat. Off. . |
| 1169872 | 1/1965 | Fed. Rep. of Germany . |
| 3024218 | 1/1982 | Fed. Rep. of Germany . |
| 2493907 | 5/1982 | Fed. Rep. of Germany . |

*Primary Examiner*—Ramon S. Britts
*Assistant Examiner*—Frank S. Tsay
*Attorney, Agent, or Firm*—Foley & Lardner

[57] ABSTRACT

A drill head for making a hole in the ground, said drill head comprising a mantle (1), a spraying device carrier (3) mounted inside the mantle (1) so it can rotate, a motor (2) installed inside the mantle (1) driving this spraying device carrier (3), at least one spraying device (4) eccentrically mounted on the spraying device carrier (3) and a pipe line (11) for fluid in order to supply fluid to the spraying device (4), characterized in that the spraying device (4) is a turbo-jet.

11 Claims, 2 Drawing Sheets

DRILL HEAD

BACKGROUND OF THE INVENTION

1. Field of the Invention

The invention pertains to a drill head for making a hole in a sub-surface or above ground structure or formation, and more particularly to a drill head comprising a mantle, a carrier for a spraying device capable of rotating mounted within the mantle, a motor mounted inside the mantle driving the spraying device carrier, at least one spraying device mounted eccentrically on the spraying device carrier, and a pipeline for supplying the fluid to the spraying device.

2. Description of the Related Art

Drill heads of this variety are known whereby two guidable spraying devices, so called nozzles, are mounted on the carrier for the spraying devices.

The cutting capacity of such a drill head is limited. For hard rocks, such a drill head should also be equipped with mechanical cutting devices.

SUMMARY OF THE INVENTION

The invention has as an objective, to provide a drill head with excellent cutting ability for making a hole in the ground, without the drill head having to be equipped with cutting devices, with which relatively large holes can be drilled in even relatively hard rock To this end the spraying device is a turbo jet.

Turbo-jets are known of their own accord and are already being used as single drill heads. It is specific to a turbo-jets that it contains a rotating part and one or more nozzles mounted on this part in such a manner, in relation to the axis of rotation of the rotating part, that this rotatable part starts rotating automatically because of the spraying. In known drill heads the turbo-jets have been mounted in a fixed position and not on a rotating spraying device carrier.

In a special embodiment of the invention the drill head includes two turbo-jets which are mounted eccentrically on the rotating spraying device carrier.

Both turbo-jets can be fed with fluid by the same pipeline.

The fluid is preferable under a pressure of up to 1500 bar or more.

The turbo-jet preferably has a speed of rotation of approximately 1500 revolutions per minute. The motor driving the spraying device carrier can be an electric motor, a hydraulic motor or an air motor, but is preferably a water motor, more especially, a so called helical-pump motor for low pressures.

A water motor offers the advantage that only a water supply hose is necessary. After driving the spraying device carrier, the water can further be used for driving the turbo-jet.

The pipeline for the pressurized fluid, advantageously extends through the motor.

In an efficient embodiment of the invention, the drill head also includes a pipeline, for the flushing liquid, which extends through the head.

The flushing liquid pipeline can be used for supplying flushing liquid, which can be returned to the surface f.i. via the outside of the drill head and the already drilled hole. The pipeline for the flushing liquid can also be used for the removal of this flushing liquid, which results from the fluid pumped through the turbo-jet and the original flushing liquid pumped around the mantle into the already drilled hole. The pipeline for the flushing liquid can be partly made up of the space between the mantle and the pipeline for fluid under pressure.

BRIEF DESCRIPTION OF THE DRAWINGS

Other particulars and advantages of the invention will appear in the following description of a drill head for making a hole in the ground, according to the invention; this description is only given as an example and does not limit the invention. The reference numbers concern the appropriate drawings, in which.

DETAILED DESCRIPTION OF THE PREFERRED EMBODIMENT

Figure 1:
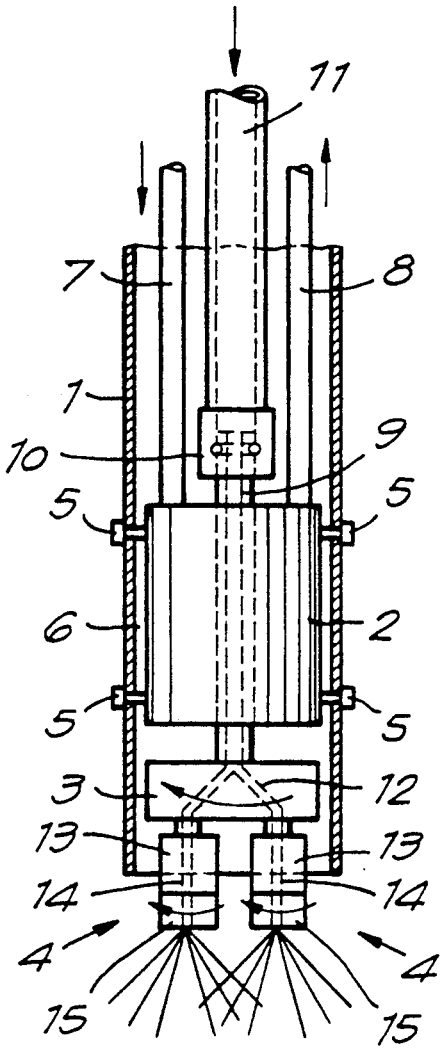
FIG. 1 schematically represents an axial cross section of a drill head according to the invention.

The drill head for making a hole in the ground according to FIG. 1 includes a mantle 1, a motor 2 mounted inside this mantle, a spraying device carrier 3 driven by the motor 2, and two turbo-jets 4 carried by the spraying device carrier 3.

The mantle 1 is the end of a supple but relatively stiff hose wound off a drum standing on the ground. Through this hose a fluid is supplied to the drill head or carried off therefrom. The motor 2 is attached inside the mantle 1 by means of bolts 5 so that between the mantle 1 and the motor casing 2, a space 6 is created. The motor 2 is an air motor or a hydraulic motor of known construction and is not described in detail. In the embodiment according to FIG. 1, a hydraulic motor 2 has been used. It is connected to an oil supply pipe 7 and an oil return line 8. Both pipelines extend inside the aforementioned mantle and continue above ground, where they are connected to a source of oil under pressure.

The shaft of the motor 2 is a hollow shaft 9. With one end, at the side of the aforementioned hose, the hollow shaft 9 is connected to a supply pipe for fluid under pressure 11, by means of a rotating coupling 10, a so called rotary seal. The pipeline 11 extends co-axially with the hose until above ground, where the pipeline 11 is connected to a pump.

The other end of this hollow shaft 9 carries the aforementioned spraying device carrier 3. The inside of the hollow shaft 9 is connected with two channels 12 extending through the spraying device carrier 3 which respectively connect to the two turbo-jets 4. The spraying device carrier 3 is a disk whose diameter is somewhat smaller than the inside diameter of the mantle 1.

Figure 3:
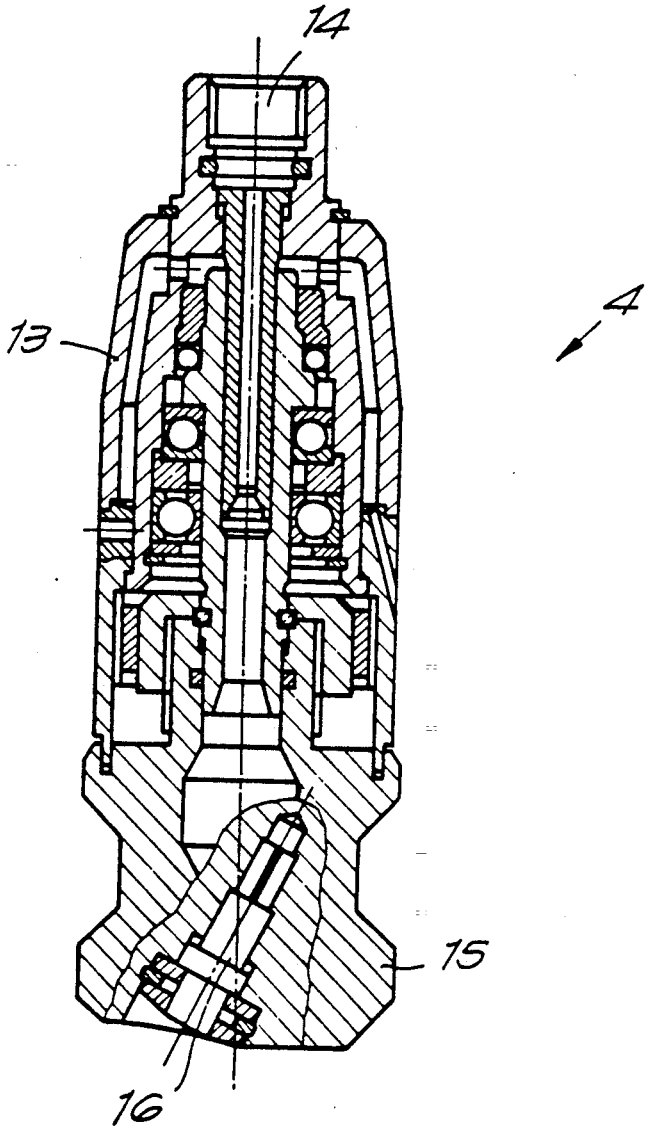
FIG. 3 represents an axial cross section of a turbo-jet according to one of the preceding figures, drawn on a larger scale.

The two turbo-jets 4 are of a known construction. An example is shown in FIG. 3. Each turbo-jet 4 includes a fixed part 13 eccentrically attached to the spraying device carrier 3 and a channel 14 being connected to one of the previously mentioned channels 12. Each turbo-jet 4 contains a pivotal end 15 which can rotate, relative to the fixed part 13 on a shaft which is parallel to the axis of rotation of the spraying device carrier 3, and a nozzle 16 connected to the aforementioned channel 14. This nozzle 16 has been directed sideways in such a fashion such that through the spraying of a fluid under pressure, the rotating end 15 starts turning automatically. The nozzle 16 can be mounted in the end 15 in a fixed or in a directable manner such that it is and be pivotal around its own axis. In the latter instance the speed of rotation of the end is can be selected for instance, between 0 and 1500 rpm. The speed of rotation of the spraying device carrier 3 depends on the formation to be penetrated and varies for instance between 0 and 500 rpm. Fluid under pressure, that is with a pressure of between 1500 bar and higher, usually a fluid such as water, is pumped through the supply pipe 11, the hollow shaft 9 and the channels 12 and 14 to the nozzles 16 of the two turbo-jets 4. This causes the ends 15 of the turbo-jets 4 to automatically rotate. The jet of the nozzles 16 in this manner uniformly covers an area that can exceed the surface as described by the mantle 1. Flushing liquid is pumped through the ring shaped space between the hose forming the extension of the mantle 1 and the supply pipe 11. This flushing liquid flows between the motor 2 and the mantle 1 past the spraying device carrier 3 and turbo-jet 4 and carries the soil along that is being loosened by turbo-jet 4. The flushing liquid flows back upwards along the outside of the mantle 1, in the hole which has already been made.

The direction of the flow of the flushing liquid can if so desired be reversed whereby the fluid is pumped downward through the hole already made and rises between motor 2 and mantle 1, and continues through the aforementioned ring shaped space. In order to ensure high upward velocities of the flushing liquid with the detached particles, venturi systems may be installed. In one variant, the spraying device carrier 3 is not directly mounted on the motor shaft 9 but is mounted on the motor casing and driven by shaft 9 by means of a mechanical drive arrangement, such as a gear transmission. In this case, the shaft 9 need not be hollow and the pipeline 11 directly connects to a passage through or next to motor 2. This passage than connects, f.i. by means of a rotary seal, to the spraying device carrier 3.

Figure 2:
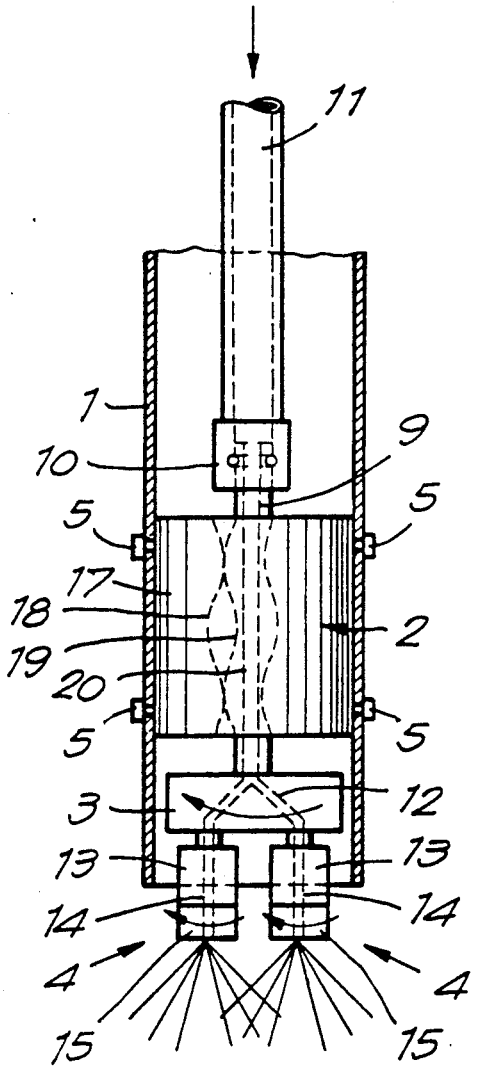
FIG. 2 schematically represents an axial cross section analogous to FIG. 1, but concerning another embodiment of the drill head according to the invention.

The embodiment of the drill head according to FIG. 2 differs from the embodiment according to FIG. 1 as described above only in that motor 2 is not a hydraulic motor but a so called helical-pump motor or water motor. Such helical-pump motors are themselves known to the trade. Such a helical-pump motor consists of a rubber casing 17 provided with a central opening 18 alternately widening and narrowing. In this opening 18 a helix 19 is installed and provided with an axial straight channel 20. The helix 19 with the channel 20 replace the hollow shaft 9 of the previously described embodiment and this helix is therefore respectively connected at both ends via the rotary seal 10 to the supply pipe for fluid under pressure 11 and the spraying device carrier 3. Channel 20 ends on the inside of pipeline 11 and in the aforementioned channels 12 in the spraying device carrier 3. The casing 17 connects to the inside of the mantle 1 so that no space is created therebetween. As in the previous embodiment, all flushing liquid, which is pumped through the ring shaped space between pipeline 11 and mantle 1 and through the hose forming its extension, must pass the opening 18 in this casing 17. This fluid will cause rotation of the helix 19 which therefore does not pump this flushing liquid but is driven by this flushing liquid. The flushing liquid flows back to a reservoir above ground via the space between the mantle 1 and the wall of the hole already drilled.

In the latter embodiment also the direction of the flow can be reversed. The flushing liquid can be supplied between the mantle 1 and the inside of the hole already made and than carried through the passage 18 mentioned before and the ring shaped space between pipeline 11 and mantle 1 and the connecting hose to the surface. In this case also helix 19 and therefore the spraying device carrier 3 will be driven. The action is analogous to the one described in the previous embodiment.

In a variant of the embodiment according to FIG. 2 the supplied fluid acts as flushing liquid as well as for driving the helical-pump motor 2. The channel 20 inside the helix 19 has been left out and the supply pipe 11 leads into passage 18 by means of a rotary seal. Fluid under pressure is only supplied by the supply pipe 11. The space between pipe 11 and mantle 1 or the connecting hose or tube can be used for the removal of the fluid whereby inside motor 2 or between motor 2 and the mantle 1 a passage for this removal should be kept open. In addition it is even possible to leave out the supply pipe 11. The fluid is pumped into the mantle and flows through passage 18. Means must be provided to supply this fluid to the turbo-jets 4. The spraying device carrier 3 can f.i. close the lower end of the mantle while channels 12 access the space between motor 2 and the spraying device carrier 3.

The drill heads described before permit drilling in hard soil without the need to equip the drill head with mechanical cutters, although application of such mechanical devices is not out of the question.

The invention is not limited to the embodiment described above and within the framework of the patent application many changes may be made, amongst others concerning the shape, the composition, the arrangement and the number of parts used for the realization of the invention.

In particular each drill head need not necessarily comprise exactly two turbo-jets, one turbo-jet already suffices but there may also be more than two.

The motor need not necessarily be a hydraulic motor or a helical-pump motor. Even an air motor, a common electrical motor may be used f.i. Instead of a helical-pump motor the head may comprise another water motor such as f.i. a motor with a turbine.

The spraying device carrier need not necessarily be a disk. It may also be a bar whose length is somewhat smaller than the inside diameter of the mantle.

What is claimed is:

1. A drill head for making a hole in the ground, the drill head comprising:

a mantle;

a spraying device carrier mounted inside the mantle so that it can rotate;

a motor installed inside the mantle for driving the spraying device carrier;

two turbo-jets each being eccentrically mounted on the spraying device carrier; and a first pipe line for supplying fluid to the turbo-jets.

2. A drill head according to claim 1, wherein the turbo-jets each include a nozzle, each of the nozzles being connected to and receiving fluid from the first pipe line (11).

3. A drill head according to claim 1, wherein the motor is a hydraulic motor.

4. A drill head according to claim 1, wherein the motor is a water motor.

5. A drill head according to claim 4, wherein the motor is a helical-pump motor.

6. A drill head according to claim 1, wherein the motor has a shaft and the first pipe line extends through the motor shaft.

7. A drill head according to claim 1, further comprising a second pipe line which extends through and provides flushing liquid to the drill head.

8. A drill head according to claim 7, wherein the second pipe line includes the mantle.

9. A drill head according to claim 8, wherein a space is defined between the motor and the mantle, the space being part of the second pipe line.

10. A drill head according to claim 7, wherein the motor is a helical-pump motor which includes a casing, a central passage, and a helix located in the central passage, and the second pipe line includes the central passage so that the flow of flushing liquid through the central passage causes a rotation of the helix inside the central passage.

11. A drill head according to claim 1, wherein the turbo-jets each include a rotating end piece and a nozzle which is disposed in the rotating end piece, and each of the nozzles are connected to the first pipe line and supplied with fluid therefrom such that the rotating end piece is forced to rotate.

* * * * *